US006655416B2

(12) United States Patent
Serillon

(10) Patent No.: US 6,655,416 B2
(45) Date of Patent: Dec. 2, 2003

(54) TEXTILE MATERIAL IN SHEET FORM FOR TECHNICAL USES

(75) Inventor: Michel Serillon, Mariac (FR)

(73) Assignee: Etablissement les Fild d'Auguste Chomarat et Cie, Paris (FR)

( * ) Notice: Subject to any disclaimer, the term of this patent is extended or adjusted under 35 U.S.C. 154(b) by 0 days.

(21) Appl. No.: 10/131,129

(22) Filed: Apr. 24, 2002

(65) Prior Publication Data

US 2003/0024592 A1 Feb. 6, 2003

Related U.S. Application Data

(63) Continuation of application No. PCT/FR00/02824, filed on Oct. 11, 2000.

(30) Foreign Application Priority Data

Oct. 25, 1999 (FR) ..... 99 13552

(51) Int. Cl.[7] ..... D03D 25/00

(52) U.S. Cl. ..... 139/420 R; 139/426 R; 139/420 A; 139/DIG. 1; 442/268; 442/301

(58) Field of Search ..... 139/420 R, 426 R, 139/420 A, 420 C, 420 D, 383 B, DIG. 1; 428/62, 102, 365, 902; 442/268, 301, 302; 28/170, 171

(56) References Cited

U.S. PATENT DOCUMENTS

| | | | | | |
|---|---|---|---|---|---|
| 3,930,091 | A | | 12/1975 | Lewis et al. | 428/198 |
| 4,714,642 | A | * | 12/1987 | McAliley et al. | 428/113 |
| 5,045,388 | A | * | 9/1991 | Bice et al. | 428/299.1 |
| 5,455,107 | A | * | 10/1995 | Homma et al. | 442/60 |
| 5,512,348 | A | * | 4/1996 | Mazelsky | 428/102 |
| 5,545,455 | A | * | 8/1996 | Prevorsek et al. | 428/76 |
| 5,578,368 | A | * | 11/1996 | Forsten et al. | 442/407 |
| 5,591,509 | A | * | 1/1997 | Lorenz et al. | 428/107 |
| 5,783,278 | A | | 7/1998 | Nishimura et al. | 428/102 |
| 5,837,624 | A | * | 11/1998 | Sakaguchi et al. | 442/208 |
| 5,876,834 | A | * | 3/1999 | Foy et al. | 428/192 |
| 6,076,564 | A | * | 6/2000 | Bruggemann et al. | 139/413 |
| 2002/0028622 | A1 | | 3/2002 | Miyasato et al. | 442/208 |

FOREIGN PATENT DOCUMENTS

| | | | |
|---|---|---|---|
| EP | 0 542 639 A1 | 5/1993 | F16L/55/17 |
| FR | 1 099 755 | 9/1955 | |
| FR | 1 394 271 | 2/1965 | |
| FR | 1 469 065 | 2/1967 | |
| FR | 2 034 787 | 12/1970 | B22B/19/00 |
| FR | 2 409 338 | 6/1979 | D04H/3/00 |
| FR | 2 568 275 | 1/1986 | D03D/11/00 |
| FR | WO 01/31100 A1 | 5/2001 | D03J/1/06 |
| GB | 1 357 355 | 6/1974 | F16L/55/18 |
| GB | 1 449 455 | 9/1976 | F16L/55/18 |
| WO | WO99/41441 | 8/1999 | |

* cited by examiner

*Primary Examiner*—John J. Calvert
*Assistant Examiner*—Robert H. Muromoto, Jr.
(74) *Attorney, Agent, or Firm*—Heslin Rothenberg Farley & Mesiti P.C.; John Pietrangelo

(57) ABSTRACT

A textile material in sheet form consisting of a warp and weft fabric produced by rovings of continuous technical filaments (for example, glass, carbon, or aramide filaments) without torsion is disclosed. The textile material may be produced according to a plain weave or derivative thereof, for example, the density of the warp threads (C) and the weft threads (T) may be balanced. The warp threads(C) or weft threads (T) are weakened or cut individually at predetermined intervals without any noticeable deterioration in the characteristics of the weft or warp threads located beneath the weakened or cut area. The areas in which a series of threads of the fabric (C) or (T) are weakened or cut may be produced with a lateral and vertical thread course between two consecutive threads.

20 Claims, 2 Drawing Sheets

TEXTILE MATERIAL IN SHEET FORM FOR TECHNICAL USES

CROSS REFERENCE TO RELATED APPLICATIONS

This application is a continuation of PCT application PCT/FR00/02824 filed on Oct. 11, 2000, which claims priority from French application FR 99.13552 filed on Oct. 25, 1999.

TECHNICAL FIELD

The present invention relates to a novel type of textile material in sheet form that can be used for technical purposes, such as reinforcing structures for composites, laminated complexes, complexes for sealing in the building field, or in public works, complexes intended for repairing pipes and, more generally, for any type of structure comprising a resin-based matrix, made of polyester or other resin, reinforced by a textile reinforcing sheet.

PRIOR ART

The use of textile sheets, especially those based on glass fibers, has been proposed for decades for reinforcing a plastic in the manufacture of laminated or molded structures with a plane or shaped, as is apparent, for example, from patents FR-A-1 469 065, FR-A-1 394 271, U.S. Pat. No. 3,930,091, FR-A-2 034 787 and FR-A-2 568 275.

Such textile structures have also been proposed for the purpose of being used in the building field and in public works for the production of impermeable membranes, especially reinforced bitumen membranes (FR 2 409 338) for producing complexes that can be used to repair pipes or similar structures, whether buried or not (EP-A-542 639).

From all these documents, it is apparent that the reinforcing structure must be tailored according to the various applications.

The base structures that have been proposed for decades for producing such reinforcements, especially since the appearance of glass yarns, are, on the one hand, mats which consist of discontinuous fibers and are in the form of a structure similar to a "felt", and, on the other hand, warp-and-weft fabrics consisting of yarns or roving assemblies based on glass yarns consisting of continuous filaments.

Apart from these types of structure, "unidirectional" sheets have also been proposed in which the glass yarns are arranged in the same longitudinal direction, these yarns being linked together either chemically (French patent 1 394 271) or by means of stitching (French patent 1 469 065).

It has also been proposed in U.S. Pat. No. 3,930,091 to produce a sheet which, unlike the previous ones, consists predominantly of glass fibers extending transversely with respect to the length of said sheet, these yarns being bound together by a binding warp thread, which is loose and consists of yarns coated with a heat-meltable or similar material, making it possible, especially after a heat treatment, to keep the weft yarns parallel to one another.

Compared with balanced warp-and-weft fabrics, such unidirectional sheets do not, however, allow articles reinforced both longitudinally and transversely to be produced.

Moreover, for many applications, the problem arises of how to have a reinforcing structure which can deform upon installing it, especially when articles molded to a shape are produced.

In the case of a reinforcement in the form of a unidirectional sheet, it is possible to obtain such "deformability" in the transverse direction with respect to the orientation of the yarns, for example by using elastic yarns as binding yarns.

In the case of a balanced warp-and-weft fabric, it may be envisioned to obtain deformability by selecting the weave.

This is because it is well known that certain weaves, of the satin or twill type, result in deformable woven structures. However, the amount of deformation possible is limited to a few percent.

Such a problem of limited possible deformability of the reinforcement also arises within the context of the use of complex structures consisting of a combination of a non-woven mat and of bidirectional or unidirectional woven structures, which are used especially for repairing pipes using a technique consisting in covering the internal surface of the structure to be renovated with a tubular structure made from a flexible complex comprising a fluid-impermeable membrane and a fibrous base structure which is impregnated with an uncured synthetic resin and, after said complex has been pressed against the surface of the structure to be repaired, in causing the resin to cure so as to form an internal "sleeving".

As regards putting such a tubular structure in place inside the pipe to be renovated, two main techniques have been used hitherto.

The first, which stems more particularly from British patent 1 357 355, consists in introducing the tubular material produced beforehand into the pipe to be renovated in such a way that the fibrous structure is positioned so as to face the surface to be renovated and the impermeable surface layer itself is located on the inside, facing the flow region.

After it has been put into place along the entire length of the pipe, the sleeve is put under pressure so that it is pressed against the internal surface. The resin is then caused to cure.

Another technique, called the "inside-out" technique, consists, as is apparent from British patent 1 449 455, in introducing the preformed sleeve with the impermeable surface lying on the outside and then, upon introduction into the pipe, in turning said sleeve inside out so that the fibrous structure comes into contact with the internal surface of the pipe and the impermeable layer lies on the inside.

Such a procedure allows the fibrous structure to be impregnated with uncured resin progressively as it is put into place inside the pipe.

Moreover, the curing may also be carried out continuously, for example by light radiation.

These two techniques, and more particularly the turning-inside-out installation technique, means having a base material which has sufficiently high mechanical properties in the length direction to ensure that it is installed.

Moreover, it is desirable that the tubular structure be able also to be deformable under the action of the stresses exerted in the transverse direction so as to allow the sleeve to rest perfectly against the surface of the wall to be renovated when the structure is pressurized, and to do so so that it follows perfectly the surface of the work to be renovated.

Consequently, in all uses involving textile reinforcements in sheet form, the problem may arise of having the possibility of deformation both in the machine direction and in the cross direction, while maintaining, in the final product (laminated article, molded article, impermeable membrane, complex for pipe repair), high mechanical properties in all directions.

SUMMARY OF THE INVENTION

What has now been found, and it is this which forms the subject of the present invention, is a novel type of fabric that can be used either by itself or combined with other structures, such as nonwoven fibrous webs, reinforcing meshes, etc., so as to constitute a complex which not only makes it possible, upon installing it, to retain good mechanical properties, especially tensile strength, both in the warp direction and in the weft direction, while still permitting deformation in the other direction, thereby ensuring in the final product mechanical properties equivalent to those conferred by a nondeformable fabric.

The invention also relates to a process and to a plant for producing such a type of fabric, as well as to the use of the latter to produce complexes such as built-up roofing membranes and pipe-repair structures.

In general, the material according to the invention consists of a warp-and-weft fabric made from twist-free roving assemblies of continuous technical filaments (glass, carbon, aramid, etc.), which roving assemblies will, in the rest of the description, be referred to by the generic term "yarns". Such a fabric is characterized in that:

- the fabric is made in a plain weave or derivative thereof, the density of the warp and the weft preferably being balanced;
- the warp yarns or weft yarns are weakened or cut individually at predetermined intervals without any appreciable deterioration in the characteristics of the weft or warp yarns lying beneath the weakening or cutting area; and
- the areas in which a series of yarns of the fabric are weakened or cut are produced with a lateral and vertical step between two consecutive yarns or groups of yarns.

In the present description, the expression "two consecutive yarns or groups of yarns" is understood to mean that the weakening or cutting carried out is either actually between two yarns with offset of a neighboring yarn or, optionally, in groups of yarns, for example simultaneously on the neighboring yarn, this offset being produced between two consecutive groups.

In the fabric according to the invention, the filament roving assemblies constituting the warp-and-weft yarns are in the form of flattened tapes, of large width compared with the thickness, the width advantageously being between 3 mm and 15 mm, and this being so, both in the warp direction and in the weft direction, whereas the thickness is advantageously between 0.30 mm and 3 mm.

The warp and weft are based on roving assemblies consisting of continuous technical filaments, such as especially glass rovings, the overall linear density of which is between 200 tex and 9600 tex, each consisting of 1 to 8 rovings, having an individual linear density of between 200 and 4800 tex. These rovings are twist-free and the weight of the fabric is in general between 300 g/m$^2$ and 3000 g/m$^2$.

The base fabric is, as indicated above, a fabric produced in a plain weave or derivative thereof. Weaves derived from plain weave, such as gros de Tours, rib, gros de Naples, hopsack or the like, allow the width of the bands of yarns in the warp direction or in the weft direction to be easily varied.

The weakened areas, which will be made either on the warp yarns or the weft yarns, are localized on one side of the material over the entire width of the roving assemblies, the interval between two weakening areas on a given yarn is between 10 and 15 cm. These areas are offset from one yarn to the yarn which is adjacent to it.

Thanks to such a design, a structure is obtained which, despite the weakening, or even the cutting of a series of its constituents (warp yarns or weft yarns), does, however, remain homogeneous and able to be manipulated and possibly allows it to be used as such.

In a preferred embodiment, such a fabric is, before the weakened or cut areas are produced, combined with a fibrous web based on discontinuous fibers, such as a glass mat, the two components being linked together by stitching or knitting, the wales extending in a parallel fashion between the warp yarns, preferably on either side of each yarn, although this is not obligatory.

Optionally, the binding may be obtained by producing not a straight seam of stitches but a true knit of the warp-knitting type, the wales extending along that side of the fabric whose constituents (warp or weft) have to be weakened or cut, and the binding loops on the reverse side of the complex consisting of the fibrous mat.

In such a case, the weakening or cutting of the yarns is preferably carried out between two wales so that the latter are not impaired.

The invention also relates to a process and to a plant allowing such a fabric or complex to be produced.

In general, the process according to the invention consists:

- in producing a warp-and-weft fabric from twist-free roving assemblies of continuous technical filaments,
- in optionally combining this fabric with a fibrous mat, and is characterized in that a complete or partial cut is made in the warp or weft yarns, at regular intervals, on one side of the fabric, without complete deterioration of the weft or warp yarn in the weakening area beneath the cut yarn, this cut being made with a lateral and vertical step between two consecutive yarns with a lateral and vertical step between two consecutive yarns or groups of yarns which are juxtaposed, working in the same way in the weave of the fabric and to do so in such a way that two consecutive yarns (or groups) can slide one past the other when the material is being used.

Such a process may be carried out in a plant which also forms part of the invention, which plant is characterized in that it comprises, placed between a feed station and a take-up station, an assembly allowing the warp or weft yarns of the fabric to be cut at regular intervals and in a manner offset from one yarn to the neighboring yarn (or group of yarns), said assembly comprising:

- two rolls driven in synchronism with the movement of the fabric;
- one of the rolls having on its surface a series of blades, the width of which corresponds substantially to the width of the yarns (or groups) to be cut, said blades being offset one with respect to another, both laterally and circumferentially in a pattern reproducing a "satin"-type weave.

When it is desired to cut the warp yarns, these blades will be arranged transversely, whereas if it is desired to cut the weft yarns, the blades will be arranged circumferentially.

The second roll is a backup roll coated with a layer of rubber or another elastomer, the pressure between the two rolls being adjustable.

Such a plant allows the action of the cutters to be precisely controlled so that the cutting is carried out only on the warp yarn (or weft yarn) of the visible fabric without the weft or the warp yarn lying beneath the fabric deteriorating.

BRIEF DESCRIPTION OF THE DRAWINGS

The invention will however be more clearly understood thanks to the description which follows, which is illustrated by the appended drawings in which.

MANNER OF REALIZING THE INVENTION

Figure 1:
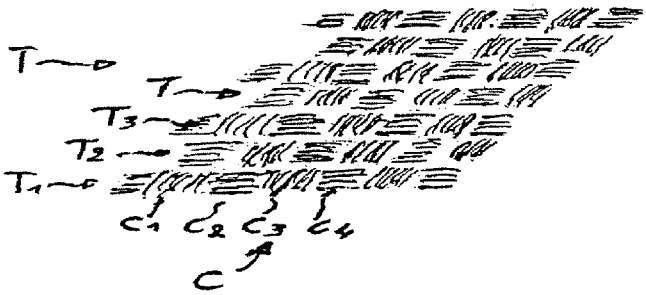
FIG. 1 illustrates, schematically, the structure of a fabric in accordance with the invention before the weakened or cut areas have been made.

FIG. 1 illustrates schematically, in perspective, the base structure of the fabric involved in the production of a material according to the invention.

Figure 2:
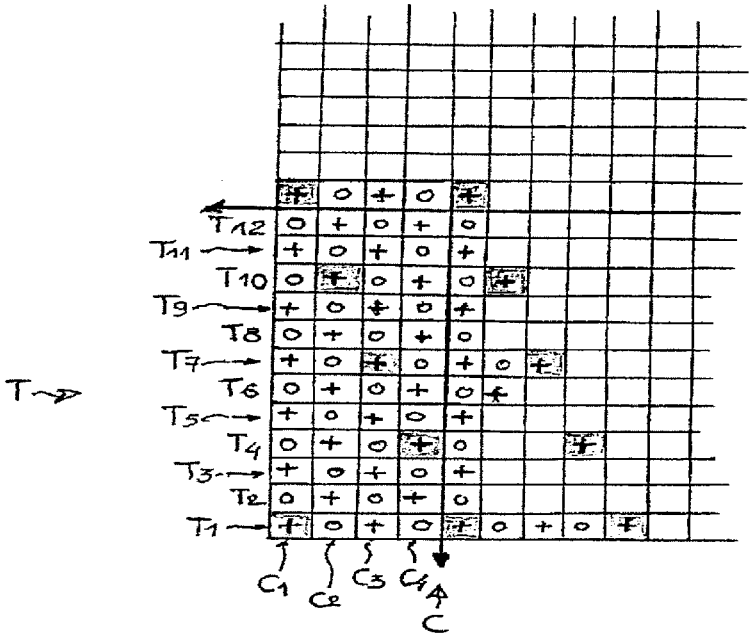
FIG. 2 is a schematic graphical representation of a fabric produced in accordance with the invention.

As regards FIG. 2, this is the graphical representation of such a fabric. In such a graphical representation, each square represents the points of intersection between the warp yarns (C) and the weft yarns (T).

When the warp yarns pass over a weft yarn, they are identified by the symbol (+) and when they pass beneath a weft yarn they are identified by the symbol (O).

Such a fabric is made in a plain weave or derivative thereof, the density of the warp (C) and the weft (T) being balanced.

To obtain a product according to the invention, these warp or weft yarns are weakened or cut individually at predetermined intervals. The areas of weakening are shown in FIG. 2 by the black areas and are produced with a lateral and vertical step between two consecutive yarns.

Referring to the example illustrated by this FIG. 2, it may be seen that the weave repeat is four yarns (C1, C2, C3, C4) per 12 weft yarns (T1 to T12).

Although such a fabric can be used as it is, according to a preferred embodiment it may be combined with a fibrous web based on discontinuous fibers, such as a glass mat, the components being bound together by stitching/knitting, said stitches extending in a parallel fashion between the warp yarns, preferably on either side of each yarn (C).

Various solutions may be envisioned for producing the weakened areas, the essential point being, during this operation, that the weft (or warp) yarn lying beneath the weakened yarn is not appreciably affected by this operation and that the consecutive warp (or weft) yarns can slide one with respect to another when the fabric is in use.

Figure 3:
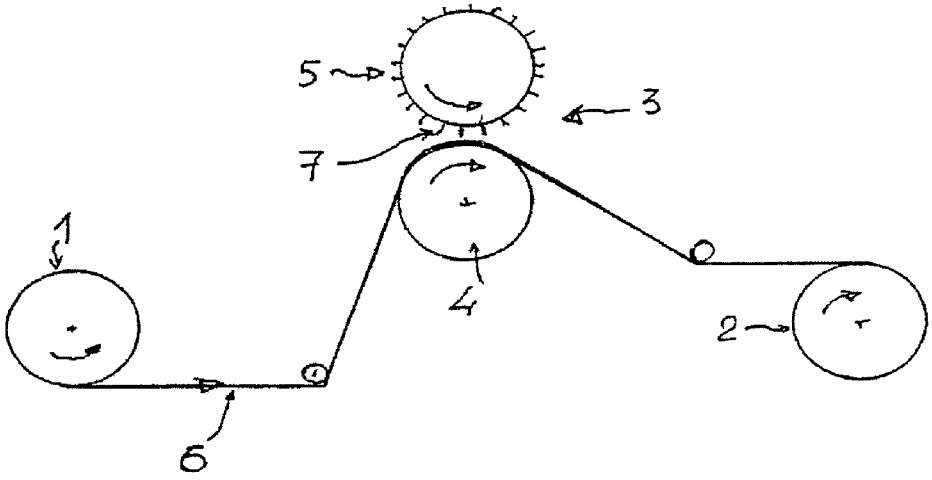
FIG. 3 is a schematic view of the entire plant for producing the weakened areas.
Figure 4:
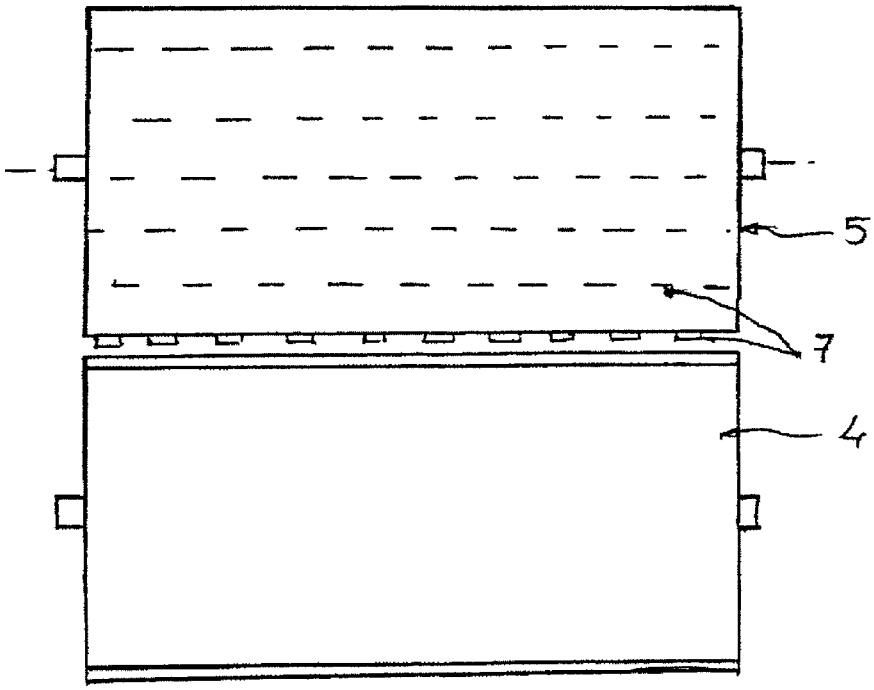
FIG. 4 is a schematic side view showing the overall structure of the cutting assembly of such a plant.

Such an operation may be carried out on a plant like that illustrated in FIGS. 3 and 4.

This plant comprises, placed between a station (1) for paying out the preformed fabric or complex and a wind-up station (2), an assembly (3) for cutting the warp or weft yarns of the fabric at regular intervals in an offset manner from one yarn (C1) with respect to the neighboring yarn (C2).

In this embodiment, the cutting assembly consists of two rolls (4, 5) driven in rotation at the same speed as the fabric or complex (6). The upper roll has a series of blades (7) fitted into its surface, the width of which corresponds approximately to the width of the cut yarns, said blades (7) being offset one with respect to another both laterally and circumferentially so as to reproduce the structure of the fabric.

When it is desired to cut the warp yarns (C), these blades are arranged transversely as illustrated in FIG. 4, whereas if it is desired to cut the weft yarns, the blades would be arranged circumferentially.

The invention and the advantages that it affords will, however, be more clearly understood from the specific illustrative examples which are given below by way of indication but which imply no limitation.

EXAMPLE 1

A warp-and-weft fabric in a plain weave is produced in the manner explained above.

This fabric is based on glass yarn roving assemblies having an overall linear density of 2400 tex both in the warp and in the weft, each roving assembly consisting of two elementary 1200 tex rovings.

The weaving is carried out in such a way that the warp yarns (C) and the weft yarns (T) are, after the fabric has been produced, in the form of flattened tapes having a width of 9 mm and a thickness of 0.5 mm.

The fabric obtained weighs 500 g/m$^2$ and exhibits no extensibility in the warp direction or in the weft direction.

According to the invention, this fabric thus produced is treated in a plant like that illustrated in FIGS. 3 and 4.

In this plant, the roll (4), which has a diameter of 30 cm, is a smooth roll coated with a rubber layer.

As regards the roll (5), the diameter of which is also 30 cm, this is provided with cutting blades (7) having a width of 10 mm, these being arranged along the generatrices of said roll.

The spacing between two consecutive blades of the same row is 108 mm, these blades being offset laterally from one row to the next. These blades project by 3 mm from the surface of the roll.

The lateral offset between these blades is 9 mm and corresponds approximately to the width of the roving assemblies (C).

After treatment, each warp yarn in the finished fabric has at least partly cut areas spaced apart by a length equivalent to 12 picks, that is to say in the present case about 108 mm.

The cutting areas are offset from one yarn with respect to the following yarn by an amount approximately equal to 3 picks.

After production, such a fabric is practically inextensible in the weft direction, whereas on the other hand it may be deformed in the warp direction thanks to the presence of the weakened areas which allow said warp yarns to move with respect to one another.

However, such a fabric does have in the warp direction a strength allowing it to be manipulated and used.

This product may be used to produce shaped laminated materials, such as reinforcement for variably shaped pipes, beams or sections of variable cross section, shaped molded parts obtained by the helical winding of the structure of the reinforcement and requiring deformation in one direction, for example for the production of blades for wind turbines or fans.

EXAMPLE 2

Example 1 is repeated except that, before the treatment to weaken the warp yarns, the fabric is combined with a glass mat weighing 300 g/m$^2$.

The fabric/nonwoven mat assembly is bound together by stitching/knitting by means of binding yarns having a linear density of 16.7 tex.

The stitching may either be simple chain stitches or it may form a knit.

In both cases, the wales preferably extend on either side of each warp yarn and are located on that side of the fabric which has to be treated.

As regards the binding meshes between the stitches, these are located on the reverse side of the nonwoven mat.

After production, such a complex weighs 810 g/m$^2$ and has a thickness of 1.10 mm.

It is particularly suitable for being used for the production of complexes employed for repairing pipes, such as those described in the preamble of the present application.

What is claimed is:

1. A textile material in sheet form, the textile material comprising a warp-and-weft fabric produced from twist-free roving assemblies of continuous technical filaments, the fabric comprising warp yarns and weft yarns, wherein at least one of the warp yarns and weft yarns are weakened or cut individually in areas at predetermined intervals with little or no appreciable deterioration in the characteristics of the weft or warp yarns lying beneath the weakened or cut areas; and wherein the weakened or cut areas are produced with a lateral step and a vertical step between two consecutive yarns.

2. The material as claimed in claim 1, characterized in that the roving assemblies of filaments constituting the warp and the weft yarns are in the form of flattened tapes having a width and a thickness, wherein the width is larger than the thickness.

3. The material as claimed in claim 2, wherein the width of the tapes is between 3 mm and 15 mm, both in the warp direction and in the weft direction, and wherein the thickness of the tapes is between 0.3 mm and 3 mm.

4. The material as claimed in claim 1, wherein the weakened or cut areas are spaced at intervals on the yarn, and wherein the interval comprises between 5 cm and 30 cm, and wherein the weakened or cut areas are offset from one yarn to the yarn which is adjacent to it.

5. The material as claimed in claim 1, wherein the material further comprises a fibrous web based on discontinuous fibers, wherein the fibrous web and the fabric are bound together by at least one of stitching and knitting.

6. A process for the production of a textile material, the method comprising:

providing a warp-and-weft fabric from twist-free roving assemblies of continuous technical filaments, the fabric comprising warp yarns and weft yarns, at least partially cutting at least one of the warp and weft yarns in areas, at regular intervals, on one side of the fabric, with little or no deterioration of the weft or warp yarn beneath the at least partially cut areas, wherein the at least partially cutting is performed with a lateral step and a vertical step between two consecutive yarns.

7. A plant for producing a textile material, the plant comprising:

a feed station for providing a warp-and-weft fabric from twist-free roving assemblies of continuous technical filaments, the fabric comprising warp yarns and weft yarns having widths;

a take-up station for collecting the textile material produced; and an assembly for at least partially cutting at least one of the warp and weft yarns of the fabric at regular intervals and in a manner offset from one yarn to the neighboring yarn, said assembly comprising:

a first roll and a second roll driven in synchronism with the movement of the fabric;

wherein the first roll comprises a series of blades, the width of each blade corresponding substantially to the width of the yarns to be cut, and wherein said blades are offset one with respect to another, both laterally and circumferentially.

8. The plant as claimed in claim 7, wherein the second roll is coated with a layer of rubber or elastomer, and wherein the pressure between the first roll and the second roll is adjustable.

9. The material as claimed in claim 2, wherein the weakened or cut areas are spaced at intervals on the yarn, and wherein the intervals comprise between 5 and 30 cm, and wherein the weakened or cut areas are offset from one yarn to the yarn which is adjacent to it.

10. The material as claimed in claim 2, wherein the material further comprises a fibrous web based on discontinuous fibers, wherein the fibrous web and the fabric are bound together by at least one of stitching and knitting.

11. The textile material as claimed in claim 1, wherein the technical filaments comprise one of glass filaments, carbon filaments, and aramid filaments.

12. The textile material as claimed in claim 1, wherein the fabric comprises one of a plain weave and a derivative of a plain weave.

13. The textile material as claimed in claim 12, wherein the density of the yarns is balanced.

14. The textile material as claimed in claim 5, wherein at least one of the stitching and knitting produces wales, and wherein the wales extend in a parallel fashion with at least one of the warp yarns on either side of the at least one warp yarns.

15. The process of as claimed in claim 6, the process further comprising combining this fabric with a fibrous mat.

16. The plant as recited in claim 7, wherein the pattern produced on the textile material comprises a "satin"-type weave.

17. The textile material as claimed in claim 1, wherein the material comprises one of a roofing membrane, a pipe-repair structure, a blade reinforcement, and a composite reinforcement.

18. The textile material as claimed in claim 1, wherein twist-free roving assemblies comprise an overall linear density of between 200 tex and 9600 tex.

19. The textile material as claimed in claim 12, wherein the derivative of a plain weave comprises one of gros de Tours weave, rib weave, gros de Naples weave, and hopsack weave.

20. The textile material as claimed in claim 5, wherein the fibrous web comprises a glass mat.

* * * * *